US011287103B2

(12) United States Patent
Palumbo et al.

(10) Patent No.: US 11,287,103 B2
(45) Date of Patent: Mar. 29, 2022

(54) LOW WATTAGE BALLOON WORK LIGHT

(71) Applicant: ISM LIGHTING, LLC., Providence, RI (US)

(72) Inventors: Nicholas Blount Palumbo, East Providence, RI (US); Ian A. McDermott, East Providence, RI (US)

(73) Assignee: ISM LIGHTING, LLC., Providence, RI (US)

( * ) Notice: Subject to any disclaimer, the term of this patent is extended or adjusted under 35 U.S.C. 154(b) by 0 days.

(21) Appl. No.: 16/854,601

(22) Filed: Apr. 21, 2020

(65) Prior Publication Data

US 2020/0332978 A1 Oct. 22, 2020

Related U.S. Application Data

(60) Provisional application No. 62/836,988, filed on Apr. 22, 2019.

(51) Int. Cl.

| | |
|---|---|
| ***F21V 3/02*** | (2006.01) |
| ***F21S 8/08*** | (2006.01) |
| ***A63H 27/10*** | (2006.01) |
| ***F21W 131/406*** | (2006.01) |

(52) U.S. Cl.

CPC ..... *F21V 3/023* (2013.01); *F21S 8/08* (2013.01); *A63H 2027/1058* (2013.01); *F21W 2131/406* (2013.01)

(58) Field of Classification Search

CPC ..... F21V 3/023; F21V 3/026

See application file for complete search history.

(56) References Cited

U.S. PATENT DOCUMENTS

| | | | | |
|---|---|---|---|---|
| 5,609,411 | A | 3/1997 | Wang | |
| 5,634,711 | A | 6/1997 | Kennedy et al. | |
| 5,782,668 | A | 7/1998 | Chabert | |
| 5,795,211 | A | 8/1998 | Carignan et al. | |
| 6,012,826 | A | 1/2000 | Chabert | |
| 6,142,415 | A | 11/2000 | Ambrico | |
| 6,148,551 | A | 11/2000 | Glass | |
| 6,238,067 | B1 | 5/2001 | Hirsch | |
| 6,305,827 | B1 | 10/2001 | Noelle | |
| 6,322,230 | B1 | 11/2001 | Medici | |
| 6,428,185 | B1 * | 8/2002 | Lin | F21V 1/06 362/253 |
| 6,527,418 | B1 | 3/2003 | Scherba | |
| 6,573,536 | B1 | 6/2003 | Dry | |
| 6,683,719 | B2 | 1/2004 | Hagenbach et al. | |
| 6,815,724 | B2 | 11/2004 | Dry | |
| 6,831,303 | B2 | 12/2004 | Dry | |
| 6,966,676 | B2 | 11/2005 | Chabert et al. | |
| 7,234,847 | B2 | 6/2007 | Yoshimori et al. | |

(Continued)

FOREIGN PATENT DOCUMENTS

| | | | |
|---|---|---|---|
| CN | 100526705 | C | 8/2009 |
| CN | 201363662 | Y | 12/2009 |

(Continued)

*Primary Examiner* — Matthew J. Peerce

(74) *Attorney, Agent, or Firm* — Adler Pollock & Sheehan P.C.

(57) ABSTRACT

A low wattage balloon work light includes an illumination unit with a light-emitting diode (LED) light bank in the range of 30 watts to 300 watts, an inflatable balloon, and a power cord to power the low wattage balloon work light.

6 Claims, 20 Drawing Sheets

(56) References Cited

U.S. PATENT DOCUMENTS

| | | | | |
|---|---|---|---|---|
| 7,242,028 | B2 | 7/2007 | Dry | |
| 7,246,913 | B2 * | 7/2007 | Ossolinski | B60P 3/18 362/96 |
| 7,252,414 | B2 | 8/2007 | Chabert | |
| 7,264,382 | B2 | 9/2007 | Yoshimori et al. | |
| 7,288,796 | B2 | 10/2007 | Dry | |
| 7,311,580 | B2 | 12/2007 | Moomaw | |
| 7,320,529 | B2 | 1/2008 | Goh et al. | |
| 7,478,779 | B2 | 1/2009 | Nguyen et al. | |
| 7,534,015 | B2 | 5/2009 | Xu et al. | |
| 7,540,633 | B2 | 6/2009 | Nishimura et al. | |
| 7,611,395 | B2 | 11/2009 | Bonsembiante | |
| 7,621,650 | B2 | 11/2009 | Nalitchaev et al. | |
| 7,641,351 | B2 | 1/2010 | Girolami | |
| 7,654,699 | B2 | 2/2010 | Chang et al. | |
| 7,699,505 | B2 | 4/2010 | Yang | |
| 7,824,079 | B2 | 11/2010 | Cuppett et al. | |
| 7,837,363 | B2 | 11/2010 | Liu | |
| 7,901,110 | B2 | 3/2011 | Mulay et al. | |
| 8,092,054 | B2 | 1/2012 | Liu et al. | |
| 8,217,594 | B2 | 7/2012 | Hu et al. | |
| 8,328,377 | B1 | 12/2012 | Kothari | |
| 8,613,527 | B1 | 12/2013 | Allen et al. | |
| 8,789,981 | B2 | 7/2014 | Harms et al. | |
| 8,858,040 | B2 | 10/2014 | Rodriguez | |
| 8,931,916 | B2 | 1/2015 | Nalitchaev et al. | |
| 8,939,593 | B2 | 1/2015 | Kothari | |
| 9,086,205 | B2 | 7/2015 | Hagenbach et al. | |
| 9,192,872 | B2 | 11/2015 | Hakam et al. | |
| 9,200,792 | B2 | 12/2015 | Sharrah et al. | |
| 9,364,113 | B2 | 6/2016 | Gary et al. | |
| 9,377,172 | B2 | 6/2016 | Chabert et al. | |
| 9,429,295 | B2 | 8/2016 | Ahn | |
| 9,696,026 | B1 | 7/2017 | Hardgrave | |
| 9,951,931 | B1 | 4/2018 | Lan | |
| 9,989,230 | B2 | 6/2018 | Yamamoto | |
| RE47,011 | E | 8/2018 | Dry | |
| RE47,025 | E | 9/2018 | Dry | |
| D829,363 | S | 9/2018 | Lan | |
| 2012/0119647 | A1 * | 5/2012 | Hsu | F21V 29/70 315/35 |
| 2013/0250578 | A1 * | 9/2013 | Lan | F21V 29/83 362/294 |

FOREIGN PATENT DOCUMENTS

| | | | |
|---|---|---|---|
| CN | 201599717 | U | 10/2010 |
| CN | 101793375 | B | 11/2011 |
| CN | 202946969 | U | 5/2013 |
| CN | 103968274 | A | 8/2014 |
| CN | 102446468 | B | 9/2014 |
| CN | 101509653 | B | 1/2015 |
| CN | 104565895 | A | 4/2015 |
| CN | 204592953 | U | 8/2015 |
| CN | 204592955 | U | 8/2015 |
| CN | 104061493 | B | 6/2016 |
| CN | 106051581 | A | 10/2016 |
| CN | 205640302 | U | 10/2016 |
| CN | 205939453 | U | 2/2017 |
| CN | 206386821 | U | 8/2017 |
| CN | 206694873 | U | 12/2017 |
| CN | 206728982 | U | 12/2017 |
| CN | 107842765 | A | 3/2018 |
| CN | 104913281 | B | 5/2018 |
| CN | 108150841 | A | 6/2018 |
| CN | 108224123 | A | 6/2018 |
| CN | 108343852 | A | 7/2018 |
| CN | 207796746 | U | 8/2018 |
| CN | 108826095 | A | 11/2018 |
| CN | 109140257 | A | 1/2019 |
| CN | 109556022 | A | 4/2019 |
| CN | 208735536 | U | 4/2019 |
| CN | 109737329 | A | 5/2019 |
| CN | 208951791 | U | 6/2019 |
| DE | 10116569 | A1 | 10/2002 |
| DE | 10210165 | A1 | 10/2003 |
| DE | 202008001551 | U1 | 5/2008 |
| DE | 102016014803 | B4 | 7/2018 |
| EP | 0834693 | B1 | 7/2001 |
| EP | 1447619 | A1 | 8/2004 |
| EP | 1630472 | B1 | 1/2009 |
| EP | 1728023 | B1 | 5/2009 |
| EP | 2123970 | A1 | 11/2009 |
| EP | 1508000 | B1 | 1/2010 |
| EP | 2229554 | B1 | 10/2013 |
| EP | 2119960 | B1 | 7/2014 |
| EP | 1358430 | B1 | 4/2016 |
| EP | 2765356 | B1 | 8/2016 |
| EP | 3282176 | A1 | 2/2018 |
| EP | 3450835 | A1 | 3/2019 |
| FR | 2862279 | B1 | 3/2007 |
| IN | 2012CH02646 | A | 4/2016 |
| JP | 2003340168 | A | 12/2003 |
| JP | 3102101 | U | 7/2004 |
| JP | 2004253172 | A | 9/2004 |
| JP | 3107294 | U | 1/2005 |
| JP | 2006092753 | A | 4/2006 |
| JP | 2006120514 | A | 5/2006 |
| JP | 3864265 | B2 | 10/2006 |
| JP | 2006309996 | A | 11/2006 |
| JP | 3902923 | B2 | 1/2007 |
| JP | 2007157526 | A | 6/2007 |
| JP | 2007335080 | A | 12/2007 |
| JP | 4122368 | B1 | 5/2008 |
| JP | 4211027 | B2 | 11/2008 |
| JP | 4324506 | B2 | 6/2009 |
| JP | 4381704 | B2 | 10/2009 |
| JP | 4415097 | B2 | 12/2009 |
| JP | 4416681 | B2 | 12/2009 |
| JP | 4502924 | B2 | 4/2010 |
| JP | 2012038695 | A | 2/2012 |
| JP | 2012160293 | A | 8/2012 |
| JP | 2013191473 | A | 9/2013 |
| JP | 5477808 | B2 | 2/2014 |
| JP | 5635560 | B2 | 10/2014 |
| JP | 5638663 | B1 | 10/2014 |
| JP | 2015130274 | A | 7/2015 |
| JP | 5830788 | B2 | 11/2015 |
| JP | 2015191690 | A | 11/2015 |
| JP | 2016046022 | A | 4/2016 |
| JP | 5975303 | B2 | 7/2016 |
| JP | 6041158 | B2 | 12/2016 |
| JP | 3210148 | U | 4/2017 |
| JP | 6159635 | B2 | 6/2017 |
| JP | 6363489 | B2 | 7/2018 |
| JP | 6367907 | B2 | 8/2018 |
| JP | 6401985 | B2 | 9/2018 |
| KR | 100888012 | B1 | 3/2009 |
| KR | 20110006116 | U | 6/2011 |
| KR | 101110125 | B1 | 1/2012 |
| KR | 101330698 | B1 | 11/2013 |
| RU | 59774 | U1 | 12/2006 |
| RU | 2365813 | C1 | 8/2009 |
| RU | 2595258 | C1 | 8/2016 |
| TW | M427509 | U | 4/2012 |
| TW | I434008 | B | 4/2014 |
| WO | 03/098097 | A1 | 11/2003 |
| WO | 2005055180 | A1 | 6/2005 |

* cited by examiner

LOW WATTAGE BALLOON WORK LIGHT

CROSS REFERENCE TO RELATED APPLICATIONS

This application claims benefit from U.S. Provisional Patent Application Ser. No. 62/836,988, filed Apr. 22, 2019, which is incorporated by reference in its entirety.

BACKGROUND OF THE INVENTION

This invention generally relates to lighting, and more particularly to a low wattage balloon work light.

In general, balloon lights are used either for decoration, for carrying advertisements where the balloon or fabric of the balloon carries such an advertisement or for the provision of a diffused light source which may be needed for filming, photography, civil works, construction, or for use by emergency services.

There continues to be a need in the illumination art for a portable, low energy-using, low wattage balloon work light.

SUMMARY OF THE INVENTION

The following presents a simplified summary of the innovation in order to provide a basic understanding of some aspects of the invention. This summary is not an extensive overview of the invention. It is intended to neither identify key or critical elements of the invention nor delineate the scope of the invention. Its sole purpose is to present some concepts of the invention in a simplified form as a prelude to the more detailed description that is presented later.

In general, in one aspect, the invention features a low wattage balloon work light including an illumination unit, a balloon, and a power cord.

In another aspect, the invention features a low wattage balloon work light including an illumination unit with a light-emitting diode (LED) light bank in the range of 30 watts to 300 watts, an inflatable balloon, and a power cord to power the low wattage balloon work light.

These and other features and advantages will be apparent from a reading of the following detailed description and a review of the associated drawings. It is to be understood that both the foregoing general description and the following detailed description are explanatory only and are not restrictive of aspects as claimed.

BRIEF DESCRIPTION OF THE DRAWINGS

These and other features, aspects, and advantages of the present invention will become better understood with reference to the following description, appended claims, and accompanying drawings where:

DETAILED DESCRIPTION

Figure 1:
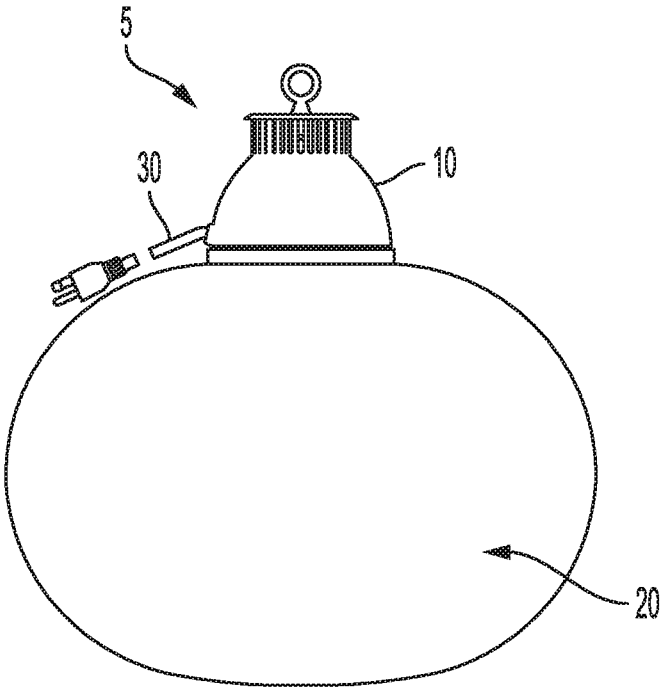
FIG. 1 is a schematic left side view of an exemplary low wattage balloon work light.

The subject innovation is now described with reference to the drawings, wherein like reference numerals are used to refer to like elements throughout. In the following description, for purposes of explanation, numerous specific details are set forth in order to provide a thorough understanding of the present invention. It may be evident, however, that the present invention may be practiced without these specific details. In other instances, well-known structures and devices are shown in block diagram form in order to facilitate describing the present invention.

This present invention generally relates to means and processes for casting visible radiant energy to render objects visible, using semiconductor devices as light-generating elements, e.g., using light-emitting diodes (LED) or, for example, a work light.

The low wattage balloon work light of the present invention can be used for light deployment, e.g., in tents, in rental stores and services, in theater and film work, in other creative arts, in lifestyle markets and as direct to consumer products.

The low wattage balloon work light of the present invention can also be used for heavy horizontal construction based deployment, e.g., nighttime road work, tunnels, mining, train track work, because they are portable and often paired with a remote power source: generator or battery pack.

Definitions

In the present invention, the term "balloon" generally refers to a lampshade for a balloon light (also called a lighting balloon), a specialized type of luminaire that typically includes one or more high-intensity lamps surrounded by a translucent fabric balloon. The balloon acts as a diffuser to soften and disperse the light. A blower can expand the balloon, or the balloon can be held open by an umbrella-like internal wire frame.

In general, "LED lights" are a light-emitting diode (LED) semiconductor light source that emits light when current flows through it, i.e., electroluminescence. The color of the light is determined by the energy required for electrons to cross the band gap of the semiconductor. White light is obtained by using multiple semiconductors or a layer of light-emitting phosphor on the semiconductor device.

The term "LED light bank" is a set of LED lights. A single or a few LED junctions may be packed in one miniature device for use as an indicator or pilot lamp. An LED array may include controlling circuits within the same package Surface-mounted LEDs are frequently produced in chip-on-board (COB) arrays. The LEDs can be arranged around a cylinder.

Figure 2:
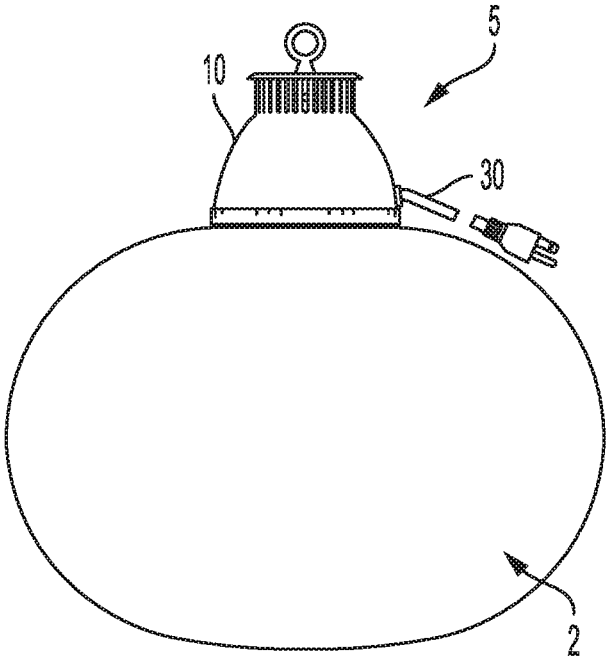
FIG. 2 is a right side view of the low wattage balloon work light.
Figure 3:
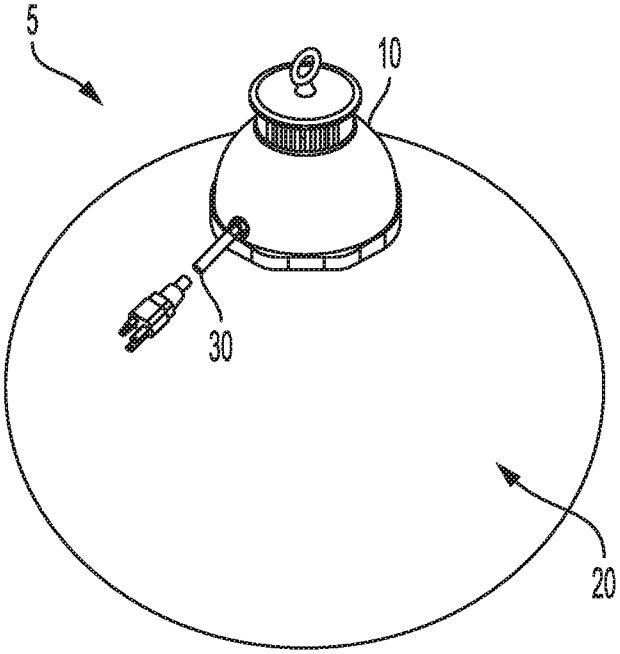
FIG. 3 is a schematic diagonal top rear view of the low wattage balloon work light.
Figure 5:
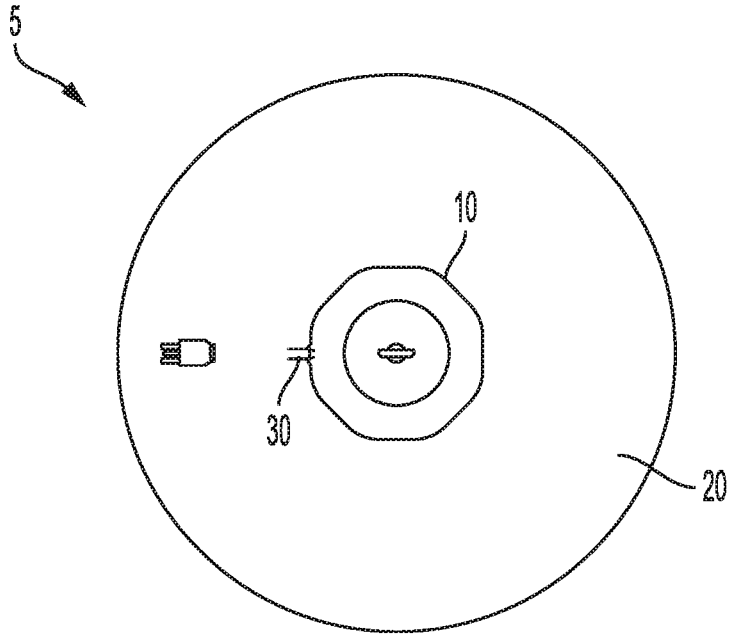
FIG. 5 is a schematic top view of the low wattage balloon work light.

Referring to the drawings, FIGS. 1-3 and 5 show an exemplary low wattage balloon work light 5 having an illumination unit 10, an inflatable balloon 20, and a power cord 30. FIG. 1 is a schematic left side view, FIG. 2 is a right side view, FIG. 3 is a top rear view and FIG. 5 is a schematic top view.

Figure 4:
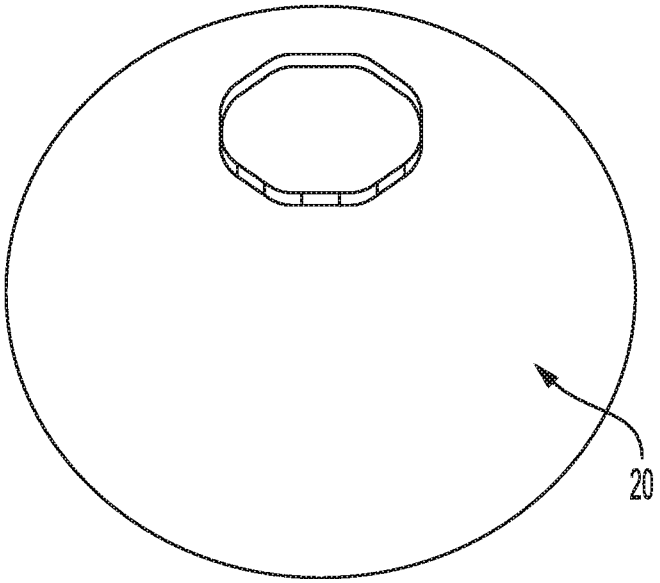
FIG. 4 is a diagonal top view of an inflated balloon.

FIG. 4 shows a diagonal top view of the inflated balloon 20 without the other components. The inflated balloon 20 is semi-permanent with a locking ring.

The low wattage balloon work light 5 can be fixed to an adjustable tripod which lifts the illumination unit 10 (as referred to a LED light 'head unit') and the balloon 20 off the ground from a range of four to fifteen 4 feet. The low wattage balloon work light 5 can be suspended inverted from a clamp mount fixed to a ceiling, tent, rafter, and so forth. In one embodiment, the low wattage balloon light 10 includes interchangeable mounts for hanging, or a tripod, and so forth (not shown).

Figure 6:
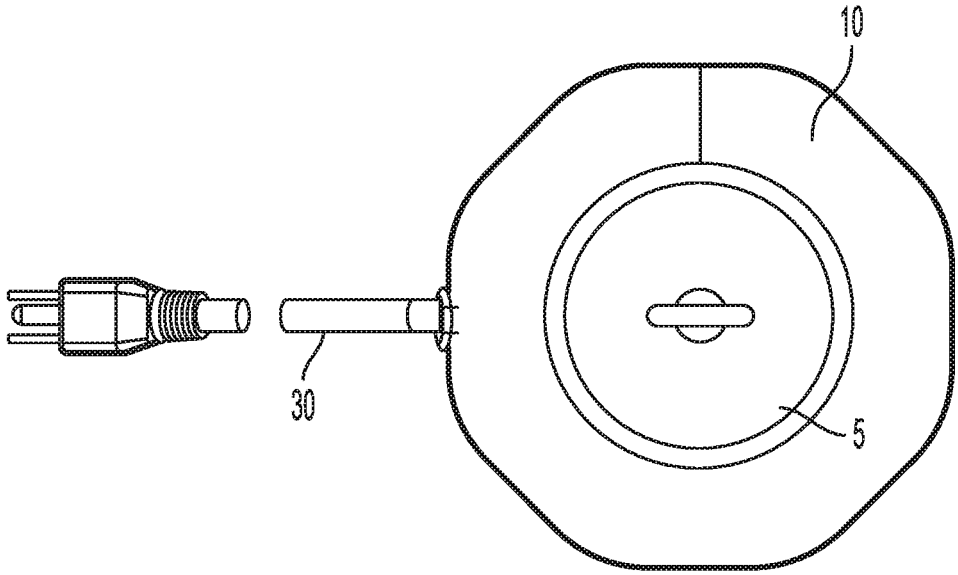
FIG. 6 is a schematic top view of the low wattage balloon work light.
Figure 7:
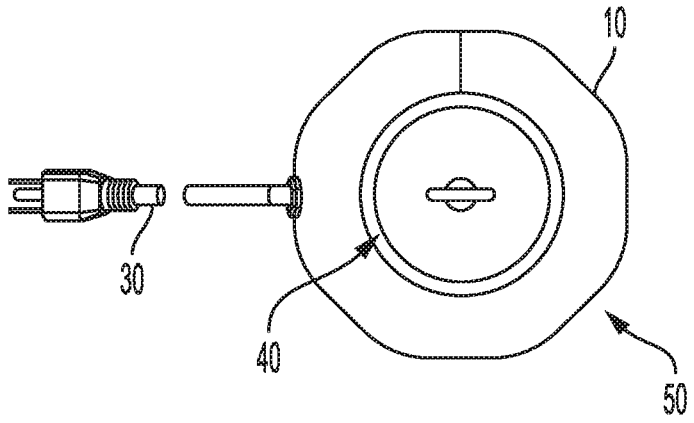
FIG. 7 is a top view of the illumination unit and a power cord.
Figure 8:
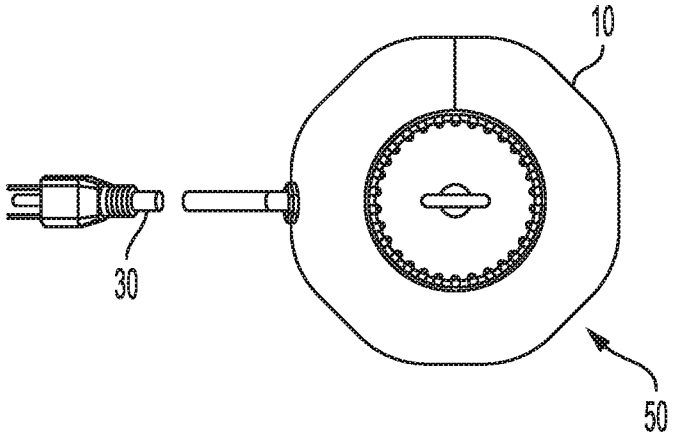
FIG. 8 is a top view of an alternative embodiment of the illumination unit and a power cord.

FIGS. 6-8 show the illumination unit 10 with the power cord 30. In one embodiment, the illumination unit 10 or the power cord 30 further has a dimmer and radio frequency (RF) remote control system (not shown), to control the illumination from the low wattage balloon light 5, preferably far away.

FIG. 7 shows an embodiment of the illumination unit 10 with a rain splash guard 40.

FIGS. 7-8 show two embodiments of a plastic top upper portion 50 of the illumination unit 10.

Figure 9:
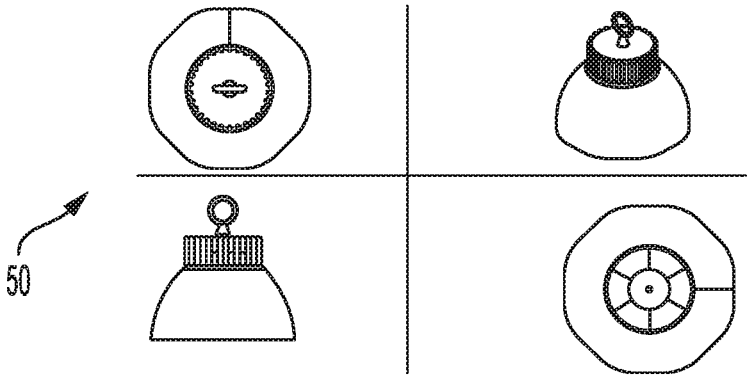
FIG. 9 shows four views of two embodiments of plastic top upper portions of the illumination unit.
Figure 10:
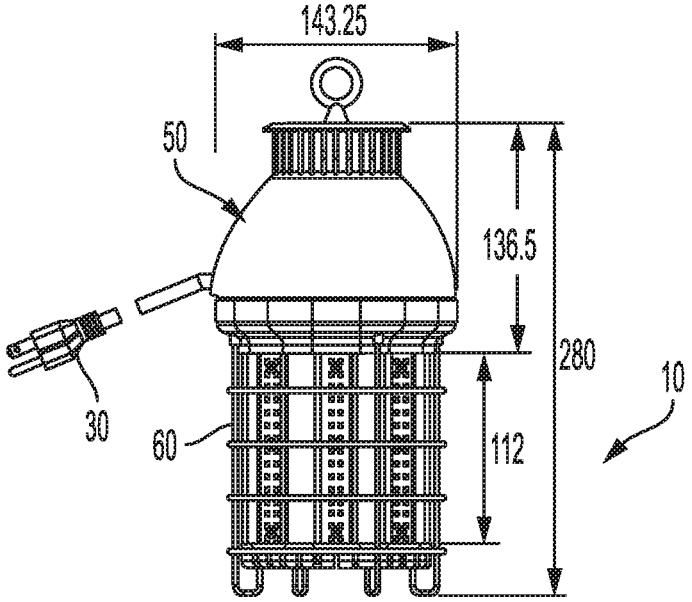
FIG. 10 is a schematic left side view of an illumination unit.
Figure 11:
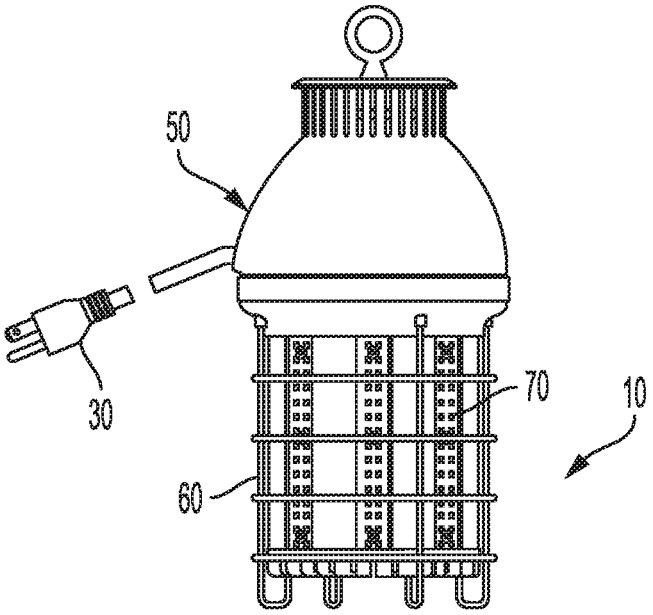
FIG. 11 is an alternative schematic left side view of an illumination unit.
Figure 12:
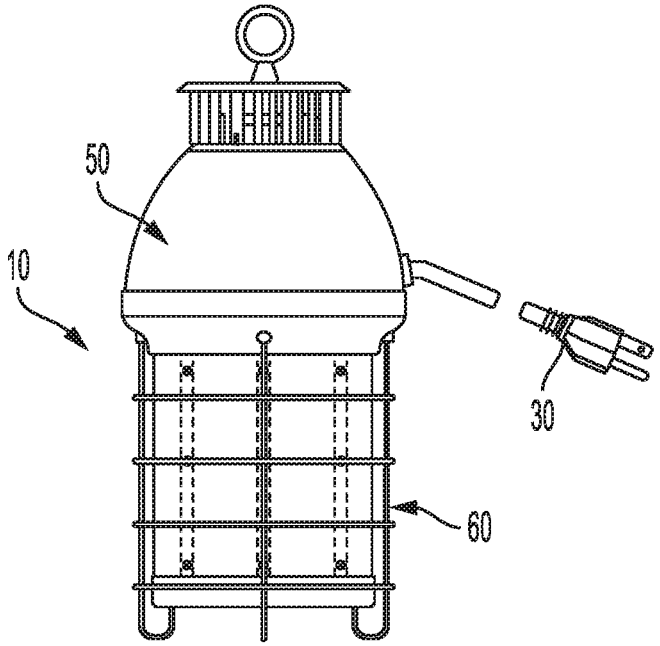
FIG. 12 is an alternative left side view of an illumination unit.

FIG. 9 shows four views of two embodiments of the plastic top upper portions 50 of the illumination unit 10.

FIGS. 10-16 illustrate multiple views of the illumination unit 10, which includes the plastic top upper portion 50, below which is a cage 60 and an LED light bank 70 located inside the cage 60. In the embodiments, the LED light bank 70 is constructed from eight outer-facing LED boards, each attached to an inner facing LED mounting and sealing plate 80. The cage 60 can be made from various materials, such as, for example, aluminum or stainless steel.

In one embodiment, the illumination unit 10 has a two-piece housing, attached with four screws.****

Figure 13:
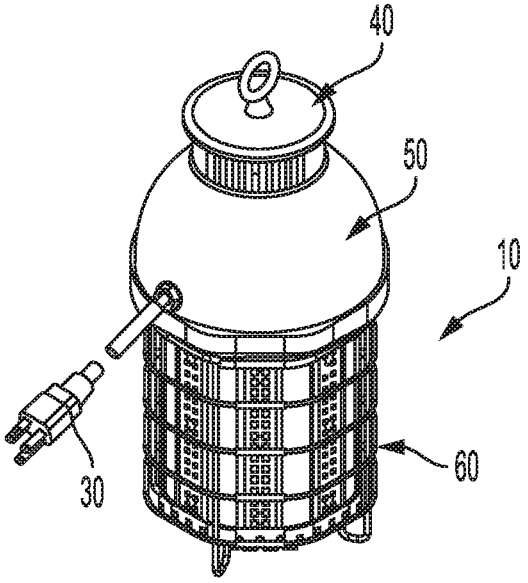
FIG. 13 is a schematic diagonal top right rear view of an illumination unit.
Figure 14:
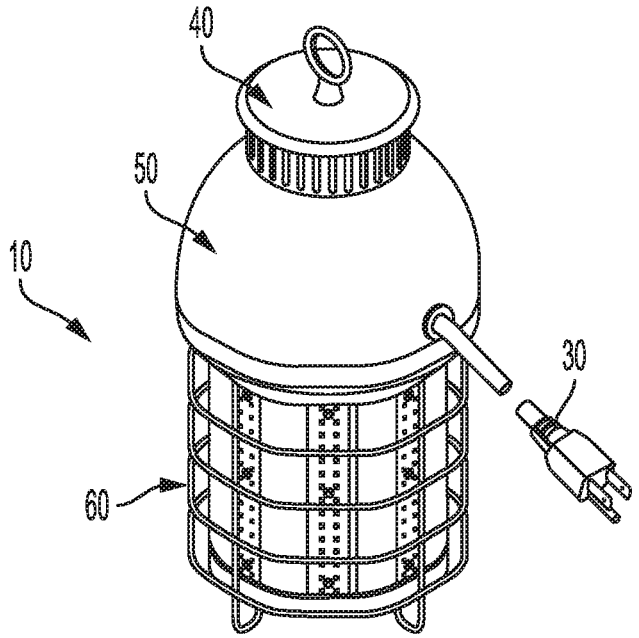
FIG. 14 is a diagonal top left rear view of an illumination unit.
Figure 15:
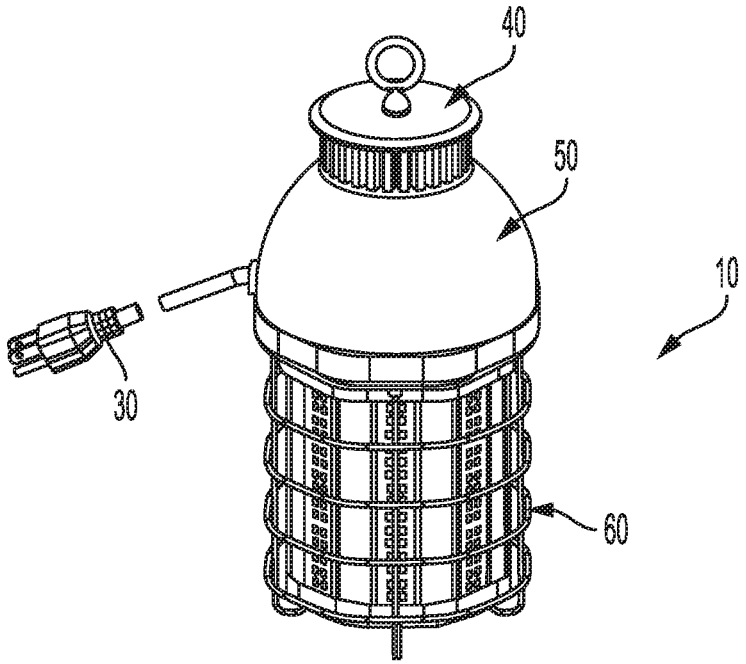
FIG. 15 is a top right rear view of another embodiment an illumination unit.

FIGS. 13-15 show the placement of the rain splash guard 40.

Figure 17:
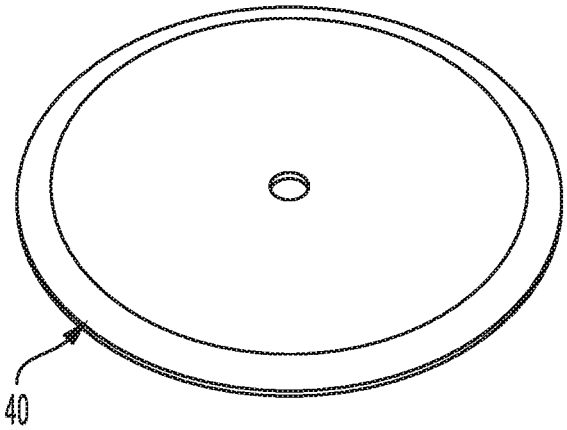
FIG. 17 is a top view of a rain splash guard.

FIG. 17 is a top view of the rain splash guard 40.

Figure 16:
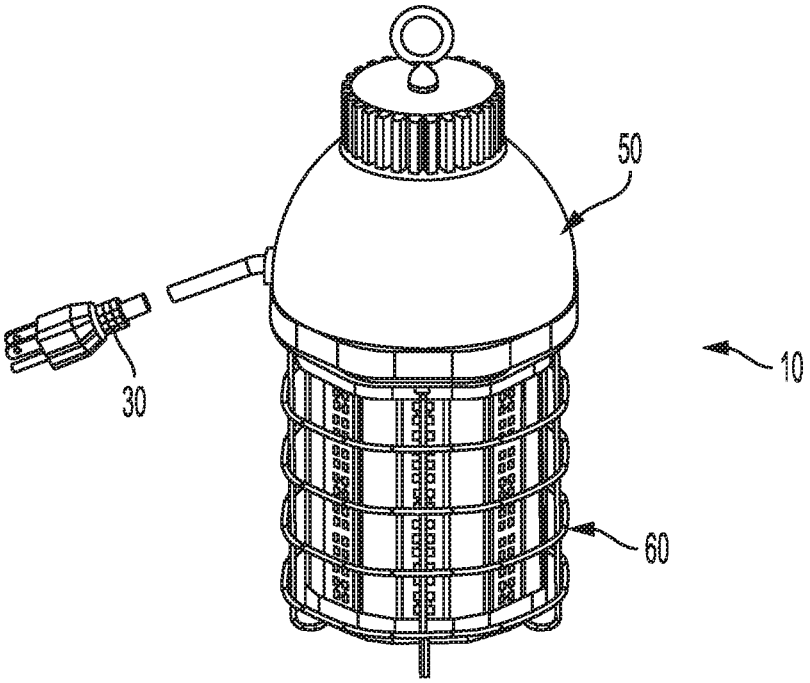
FIG. 16 is a top right rear view of an illumination unit.
Figure 18:
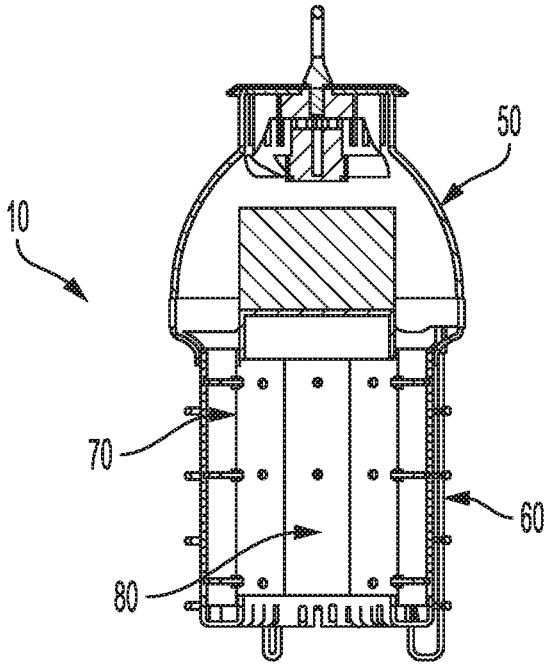
FIG. 18 is a center-sliced view of the illumination unit.

FIG. 18 is a cross-section of the illumination unit 10 shown in FIG. 16.

Shown in a center of FIG. 18 is a back side of the LED light banks 70, showing three of the eight inner LED mounting and sealing plates 80, to which are attached.

Figure 19:
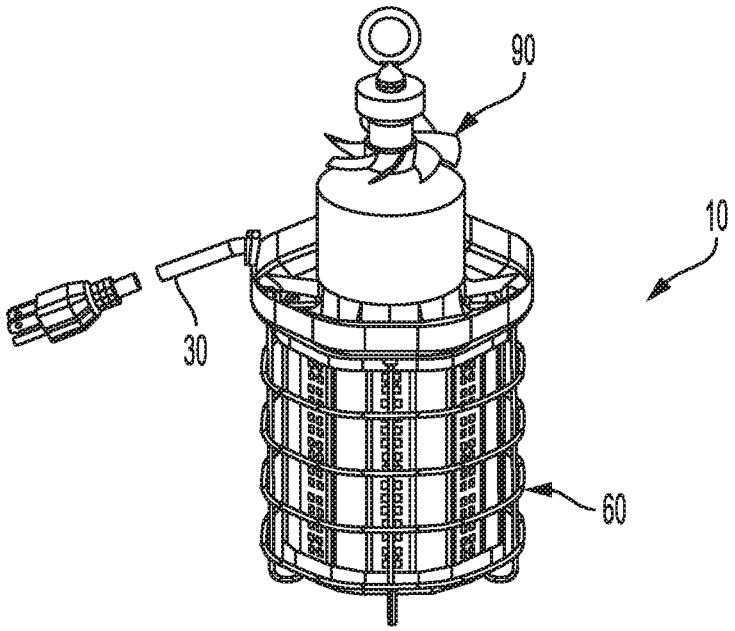
FIG. 19 is a view of the illumination unit.
Figure 20:
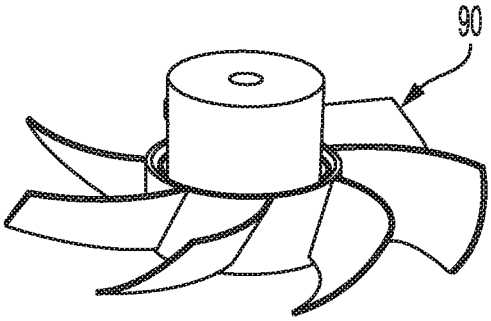
FIG. 20 is a view of the fan.

FIG. 19 is a view of the illumination unit 10 with the plastic top upper portion removed, showing a placement of a fan 90. In the embodiments, the fan 90 is a 70×70×25 fan stand-in. A directional fan is used for inflation and cooling of the heatsink.

In another embodiment, an 'air-chamber' inside of the housing has a height of 29.3 mm between the driver and the fan.

Figure 21:
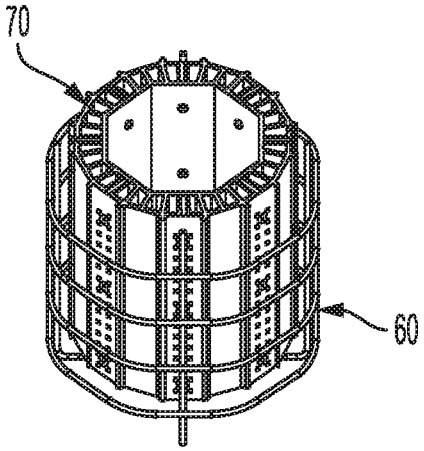
FIG. 21 is a view of the LED light panels.

FIG. 21 is a view of the LED light panels 70 and cage 60 shown in FIG. 19.

Figure 22:
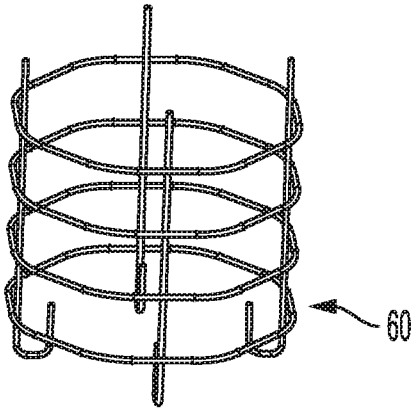
FIG. 22 is a view of the cage.

FIG. 22 is a view of the cage 60 shown in FIG. 19.

Figure 23:
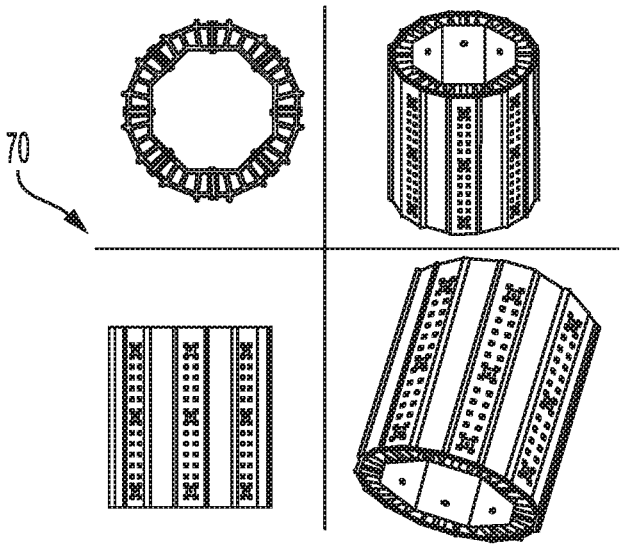
FIG. 23 illustrates views of the LED light panels.

FIG. 23 illustrates multiple views of the LED light panels 70 shown in FIG. 19.

Figure 24:
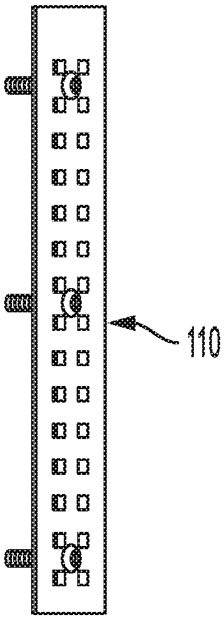
FIG. 24 is a view of one of the eight LED boards.

FIG. 24 is a view of a single LED boards 110 from the LED light panels 70 shown in FIG. 23.

Figure 25:
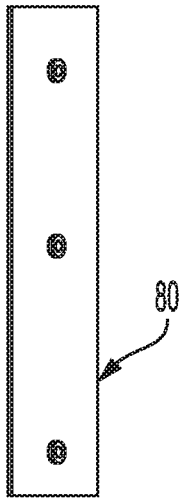
FIG. 25 is a view of one of the eight inner LED mounting and sealing plates.

FIG. 25 is a view of one of the eight inner LED mounting and sealing plates 80 to which the LED boards 110 in FIG. 24 are attached.

Figure 26:
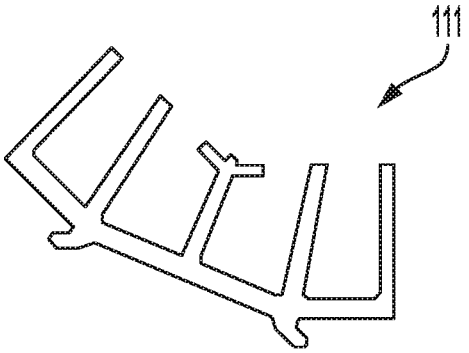
FIG. 26 is a view of one of the eight heatsink extrusion profiles.

FIG. 26 is a view of one of eight heatsink extrusion profiles 111 for the embodiment in FIG. 21. The heatsink can be composed of one or more lower parts, to lower manufacturing costs. The low wattage balloon work light 5 of the present invention can contain openings that send air directly into the balloon, instead of the air passing through the heatsink 111. In one embodiment, the air intake has a height of about 10 mm. In another embodiment, there are four air intakes on the bottom housing 113.

Figure 27:
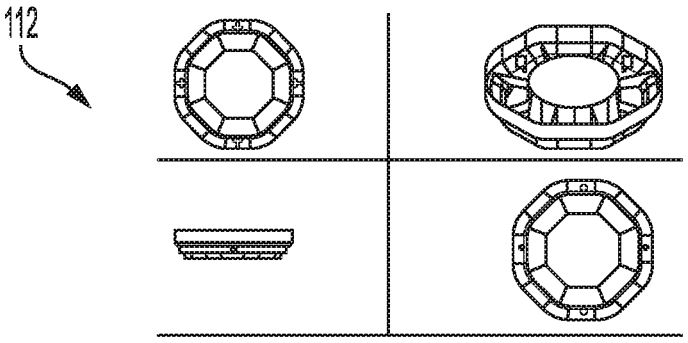
FIG. 27 shows four alternative plastic units for the illumination unit.

FIG. 27 shows four alternative plastic units 112 for the illumination unit 10 as shown in FIG. 19.

Figure 28:
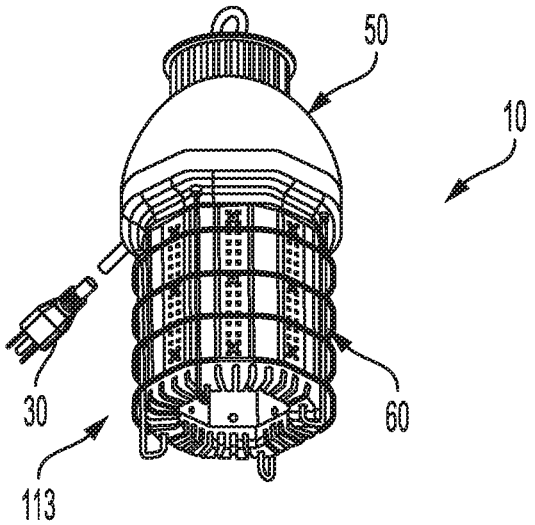
FIG. 28 is a bottom left side view of an illumination unit.

FIG. 28 is a bottom left side view of the illumination unit 10, with the power cord 30, the plastic top upper portion 50, cage 60, and the plastic bottom portion 113.

Figure 29:
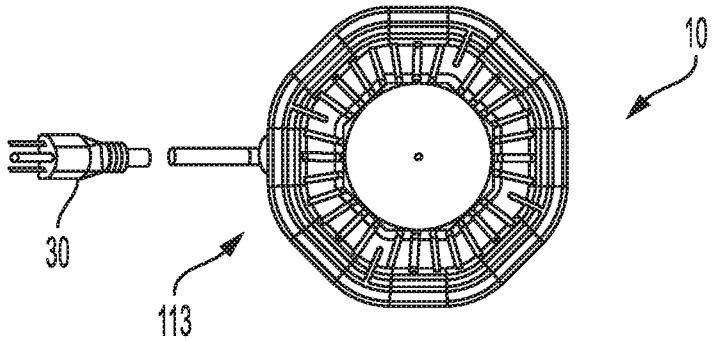
FIG. 29 is a bottom view of the illumination unit.

FIG. 29 is a bottom view of the illumination unit 10, with a power cord 30 and a plastic bottom portion 113.

Figure 30:
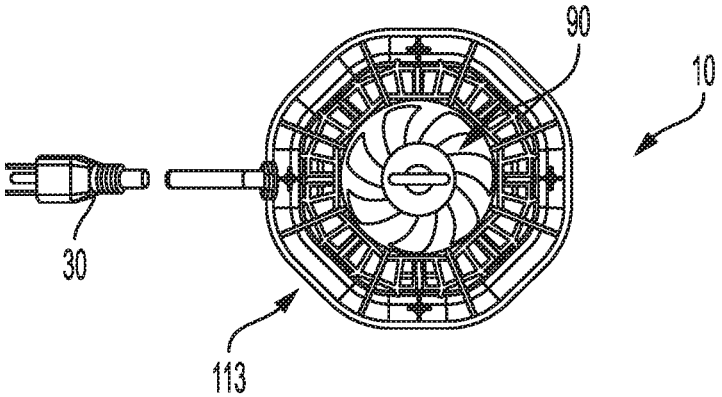
FIG. 30 is a bottom view of the illumination unit.

FIG. 30 is a bottom view of the illumination unit 10, with a power cord 30 and a plastic bottom portion 113, showing a fan (9).

Figure 31:
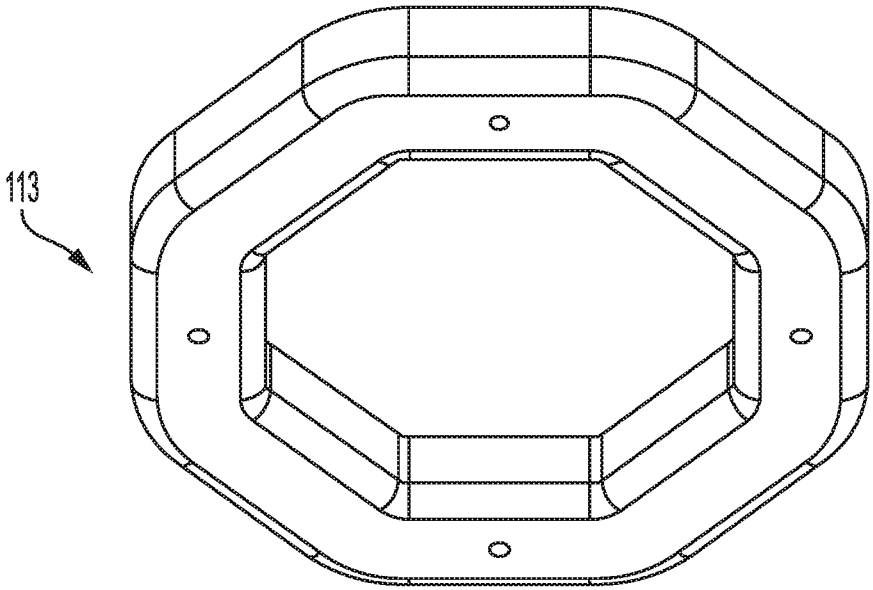
FIG. 31 is a view of an alternative plastic bottom portion of the illumination unit.

FIG. 31 is a view of an alternative plastic bottom portion 113 of the illumination unit 10.

Figure 32:
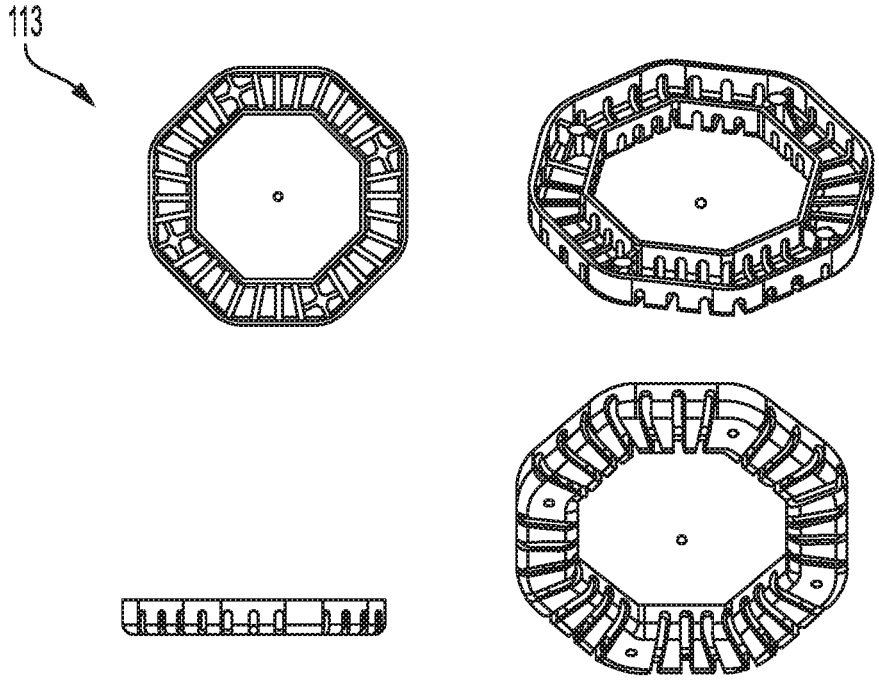
FIG. 32 shows four views of plastic bottom portions of the illumination unit.

FIG. 32 shows four views of plastic bottom portions 113 of the illumination unit 10.

Figure 33:
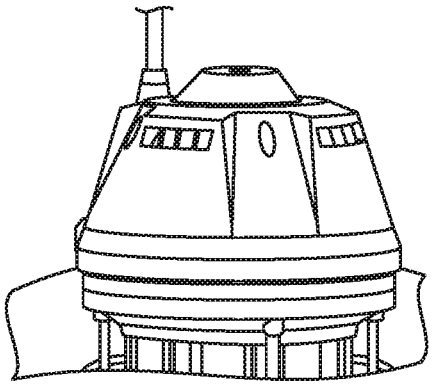
FIG. 33 shows a Low Wattage Balloon Light Housing.

FIG. 33 shows a Low Wattage Balloon Light Housing 10 mm Spacing at Intake.

Figure 34:
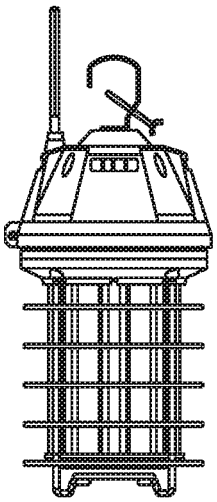
FIG. 34 shows a Low Wattage Balloon Light Exterior Profile.

FIG. 34 shows a Low Wattage Balloon Light Exterior Profil (no balloon).

Figure 35:
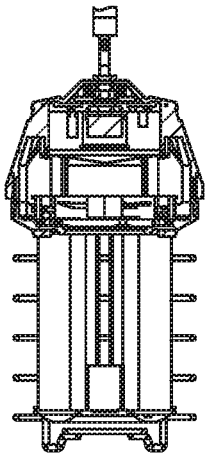
FIG. 35 shows a Low Wattage Balloon Light Interior Profile.

FIG. 35 shows a Low Wattage Balloon Light Interior Profile.

Figure 36:
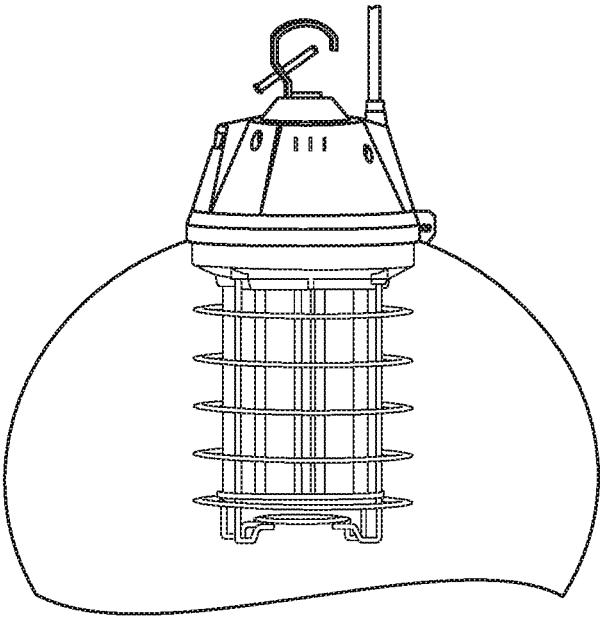
FIG. 36 shows a Low Wattage Balloon Light Exterior Profile.

FIG. 36 shows a Low Wattage Balloon Light Exterior Profile balloon).

Figure 37:
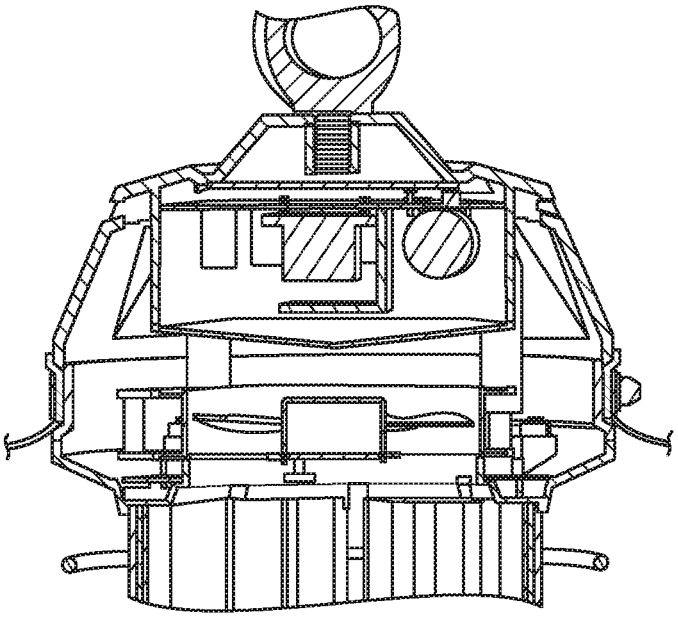
FIG. 37 shows an Interior Cross Section of Housing.

FIG. 37 shows an Interior Cross Section of Housing, Driver, Fan, Hanging Ring.

Figure 38:
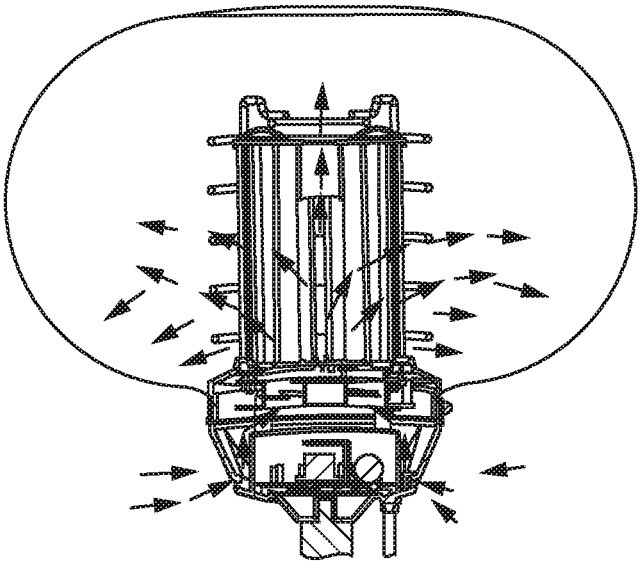
FIG. 38 shows a Low Wattage Balloon Light Interior Airflow Profile.

FIG. 38 shows a Low Wattage Balloon Light Interior Airflow Profile.

Figure 39:
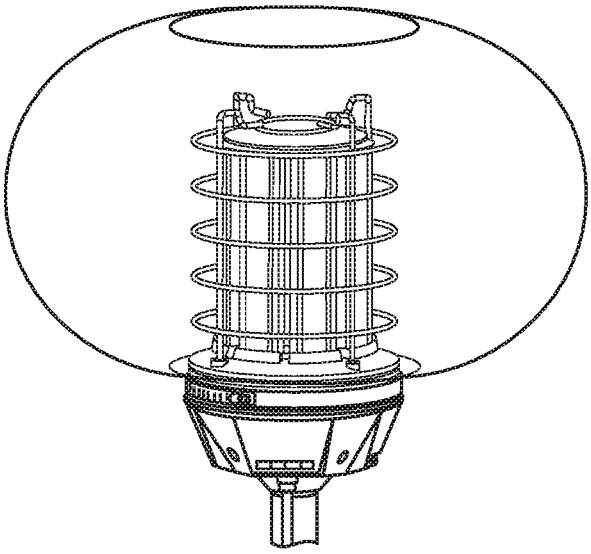
FIG. 39 shows a Low Wattage Balloon Light Exterior Profile.
Figure 40:
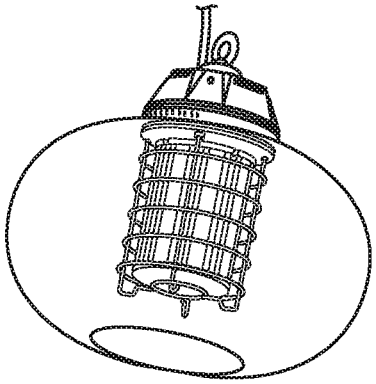
FIG. 40 shows a Low Wattage Balloon Light Exterior Profile.

FIG. 39 shows a Low Wattage Balloon Light Exterior Profile. FIG. 40 shows a Low Wattage Balloon Light Exterior Profile (balloon).

Figure 41:
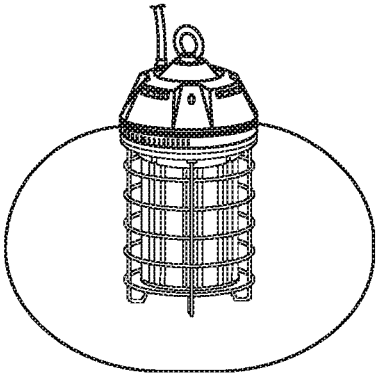
FIG. 41 shows a Low Wattage Balloon Light Exterior Profile.

FIG. 41 shows a Low Wattage Balloon Light Exterior Profile (balloon).

Figure 42:
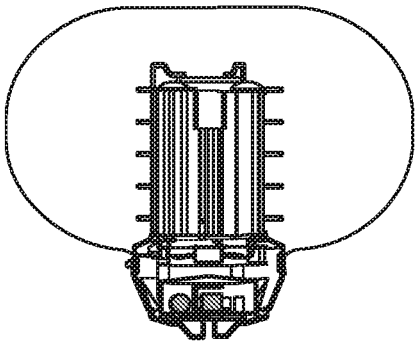
FIG. 42 shows a Low Wattage Balloon Light Interior Profile.

FIG. 42 shows a Low Wattage Balloon Light Interior Profile and Dimensions (balloon).

Figure 43:
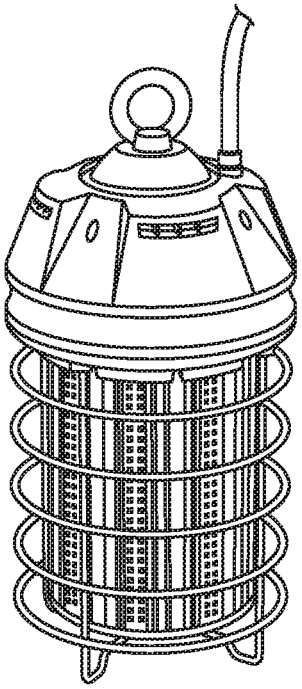
FIG. 43 shows a Low Wattage Balloon Light Product Profile.

FIG. 43 shows a Low Wattage Balloon Light Product Profile (no balloon).

Figure 44:
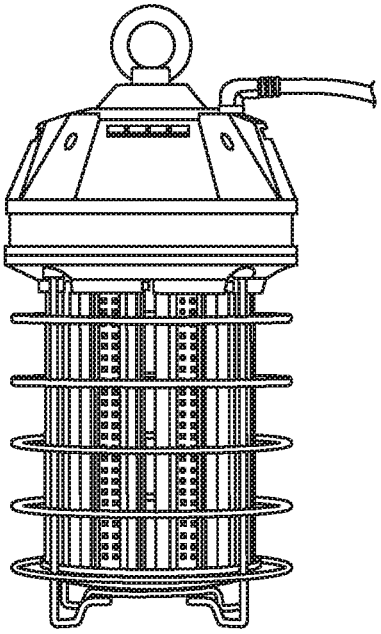
FIG. 44 shows a Low Wattage Balloon Light Product Profile.

FIG. 44 shows a Low Wattage Balloon Light Product Profile 3*a* (no balloon), with the cable directed away.

Figure 45:
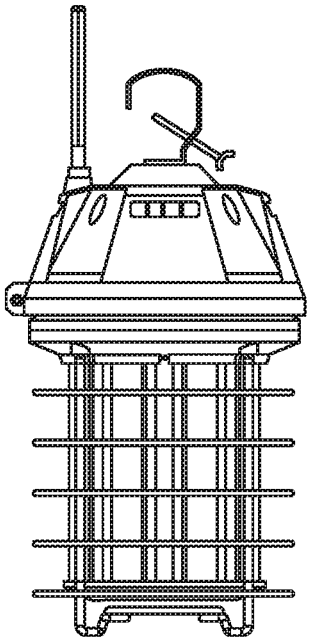
FIG. 45 shows a Computer Aided Design (CAD) drawing.

FIG. 45 shows a Computer Aided Design (CAD) drawing.

Figure 46:
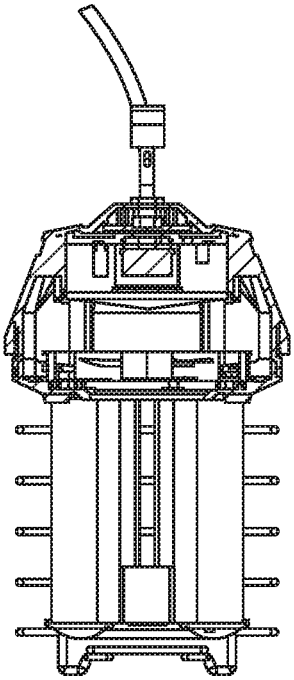
FIG. 46 shows a Computer Aided Design (CAD) drawing.

FIG. 46 shows a CAD drawing.

In summary, The invention provides a low wattage balloon work light. In a first embodiment, the low wattage balloon work light contains an illumination unit with an LED light bank in the range of between 30 watts (30 w)-300 watts (300 w), a balloon, and a power cord to power the low wattage balloon work light. The balloon may be inflatable. An advantage of the low wattage balloon work light is the use of an LED light bank that uses wattage of fewer than 300 watts. Another advantage of the low wattage balloon work light is its portability.

In a second embodiment, the illumination unit with an LED light bank is in the range of 60 watts-150 watts (60 w-150 w).

In a second embodiment, the low wattage balloon work light further includes a fan. Fan-forced air is useful for cooling the LED light bank during operation. The fan is also used to inflate and cool the heatsink.

In a fourth embodiment, the low wattage balloon work light includes a heatsink composed of one or more lower parts, to lower manufacturing costs. In a fifth embodiment, the low wattage balloon work light contains openings that send air through the heatsink and into the balloon.

Different aspects of the invention can be used independently or with one another.

It would be appreciated by those skilled in the art that various changes and modifications can be made to the illustrated embodiments without departing from the spirit of the present invention. All such modifications and changes are intended to be within the scope of the present invention except as limited by the scope of the appended claims.

What is claimed is:

1. A low wattage balloon work light comprises:

a base housing, the base housing having a plurality of air intakes configured to feed air into a directional fan;

an extruded aluminum heat sink;

an inflatable translucent fabric balloon comprising a light diffusing structure; and a power cord, wherein the directional fan is positioned to feed air from the plurality of intakes through the extruded aluminum heat sink to cool a LED light bank and inflate the translucent fabric balloon, wherein the extruded aluminum heat sink is positioned above the directional fan, wherein the LED light bank is bonded to the extruded aluminum heat sink to form an illumination unit, the LED light bank in a range of 30 watts to 300 watts, wherein the translucent fabric balloon is inflated to a predefined shape and distance to the illumination unit to achieve uniform diffusion, wherein the illumination unit is enclosed by the translucent fabric inflatable balloon, wherein the translucent fabric balloon is secured to the illumination unit by an elastic collar and clamped in place with a locking ring to provide a seal to maintain inflation pressure.

2. The low wattage balloon work light of claim 1 wherein the LED light bank is in a range of 60 watts to 150 watts.

3. The low wattage balloon work light of claim 1 wherein the fan is further configured to cool the extruded aluminum heatsink.

4. A low wattage balloon work light, comprising:

a base housing, the base housing having a plurality of air intakes configured to feed air into a directional fan;

an extruded aluminum heat sink;

an inflatable translucent fabric balloon comprising a light diffusing structure; and a power cord, wherein the directional fan is positioned to feed air from the plurality of intakes through the extruded aluminum heat sink to cool a LED light bank and inflate the translucent fabric balloon, wherein the extruded aluminum heat sink is positioned above the directional fan, wherein the LED light bank is bonded to the extruded aluminum heat sink to form an illumination unit, the LED light bank in a range of 30 watts to 300 watts, wherein the translucent fabric balloon is inflated to a predefined shape and distance to the illumination unit to achieve uniform diffusion, wherein the illumination unit is enclosed by the translucent fabric inflatable balloon;

wherein the illumination unit is enclosed by a metal cage with bars that are fixed to the base housing to provide mechanical impact protection to the illumination unit, wherein the translucent fabric balloon is secured to the illumination unit by an elastic collar and clamped in place with a locking ring to provide a seal to maintain inflation pressure.

5. The low wattage balloon work light of claim 4 wherein the LED light bank is in the range of 60 watts to 150 watts.

6. The low wattage balloon work light of claim 4 wherein the metal cage is constructed of stainless steel.

* * * * *